US009358676B2

(12) United States Patent
King, Jr. et al.

(10) Patent No.: US 9,358,676 B2
(45) Date of Patent: Jun. 7, 2016

(54) POCKET FIELD TOOL

(71) Applicants: L. Herbert King, Jr., Jupiter, FL (US); James Keeven, O'Fallon, MO (US); Steven Rhea, St. Peters, MO (US)

(72) Inventors: L. Herbert King, Jr., Jupiter, FL (US); James Keeven, O'Fallon, MO (US); Steven Rhea, St. Peters, MO (US)

(73) Assignee: Patent Store LLC, O'Fallon, MO (US)

( * ) Notice: Subject to any disclaimer, the term of this patent is extended or adjusted under 35 U.S.C. 154(b) by 309 days.

(21) Appl. No.: 13/987,974

(22) Filed: Sep. 20, 2013

(65) Prior Publication Data

US 2015/0082953 A1 Mar. 26, 2015

(51) Int. Cl.
*B25F 1/00* (2006.01)
*B25G 1/08* (2006.01)

(52) U.S. Cl.
CPC . *B25F 1/003* (2013.01); *B25G 1/08* (2013.01); *Y10T 83/0481* (2015.04)

(58) Field of Classification Search
CPC ..... B25F 1/003; B25F 1/04; B25G 1/08; Y10T 83/0481
USPC ..... 7/114, 168; 30/363; 72/325; 83/30, 49, 83/52, 684, 685; 137/318
See application file for complete search history.

(56) References Cited

U.S. PATENT DOCUMENTS

| | | | | | |
|---|---|---|---|---|---|
| 18,206 | A * | 9/1857 | Lamson | 7/128 |
| 1,187,842 | A * | 6/1916 | Kaas | 7/168 |
| 2,566,738 | A | 9/1951 | Mitchell | |
| 4,268,927 | A * | 5/1981 | Bridwell | 7/143 |
| 4,987,626 | A * | 1/1991 | Montgomery et al. | 7/127 |
| 5,014,379 | A * | 5/1991 | Hull et al. | 7/127 |
| 5,280,659 | A * | 1/1994 | Park | 7/128 |
| 5,432,968 | A * | 7/1995 | Beck | 7/128 |
| 5,526,723 | A * | 6/1996 | Sormunen et al. | 81/487 |
| 5,664,274 | A * | 9/1997 | Collins | 7/129 |
| 5,809,600 | A * | 9/1998 | Cachot | 7/128 |
| 5,910,174 | A * | 6/1999 | Finn | 7/127 |
| 5,926,885 | A * | 7/1999 | Williams | 7/165 |
| 6,014,787 | A | 1/2000 | Rivera | |
| 6,681,796 | B2 * | 1/2004 | King, Jr. | 137/318 |
| 6,751,874 | B2 * | 6/2004 | Eldar | 30/363 |
| 6,901,643 | B1 * | 6/2005 | Krasner et al. | 29/268 |
| 6,978,504 | B1 * | 12/2005 | Smith et al. | 7/165 |
| 7,020,923 | B1 * | 4/2006 | Jangula | 7/166 |
| 7,185,569 | B2 * | 3/2007 | Knight et al. | 81/450 |
| 7,347,128 | B2 * | 3/2008 | Rivera et al. | 81/450 |
| 7,634,956 | B2 | 12/2009 | Rivera et al. | |
| 7,997,170 | B1 | 8/2011 | Martinez et al. | |
| 8,424,425 | B2 * | 4/2013 | Frazer | 81/427.5 |
| 8,544,370 | B2 * | 10/2013 | Lamar | 81/460 |
| 2004/0089738 | A1 * | 5/2004 | Heren et al. | 239/271 |
| 2004/0222321 | A1 * | 11/2004 | Golan et al. | 239/542 |
| 2008/0000338 | A1 * | 1/2008 | Lockhart et al. | 83/685 |
| 2011/0145998 | A1 | 6/2011 | Caniparoli et al. | |
| 2011/0173759 | A1 * | 7/2011 | Taiga | 7/118 |
| 2013/0097786 | A1 * | 4/2013 | Hardinge et al. | 7/128 |

* cited by examiner

*Primary Examiner* — David B Thomas
(74) *Attorney, Agent, or Firm* — Jacobson & Johnson LLC

(57) ABSTRACT

A foldable pocket field tool having a foldable pliers and a set of specialty field tool bits to enable the foldable pocket tool to be carried on a person and used on-the-go with the field tool having a set of tool bits tool bits extendable or retractable into a handle and with each of the tool bits operable for efficiently performing a unique service tasks that may occur when installing or servicing a field system such as an irrigation system. The tool bits may be arranged to provide a two-part handle for use in manipulating an adjacent tool bit about a central axis as the tool bit is supported by the foldable pocket tool.

20 Claims, 5 Drawing Sheets

POCKET FIELD TOOL

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

The concept of foldable pocket utility tools is known in the art and such pocket utility tools typically include a pliers and a number of general purpose tools such as a can opener, a screw driver, a knife or a saw which make the pocket tool useful in an emergency, however, the general purpose tools, which are attached to the pocket tool, invariably do not perform as efficiently or effectively as a conventional standalone industrial tool. Consequently, pocket tools while generally useful are not necessarily desirable for a technician who uses specialty tools to perform field tasks. For example, in servicing a field system, such as an irrigation system, a service technician may carry a tool kit with multiple specialty tools which can be used in servicing the field system. Each of the tools have a specific function and are designed to conveniently and effectively perform a function. However, there are times when a service technician may encounter a need for his specialty tools but he may be not carrying the specialty tool kit. For example, the technician may notice that some adjustment to an apparatus of the field system may be necessary. If the tool kit with the specialty tools is not available the service technician must leave the job site and retrieve his specialty tool kit before the technician can make the necessary adjustments. The invention described herein allows the service technician to avoid delays in retrieving a tool kit and allow the service technician to efficiently perform on-the-go adjustments or minor repairs to the field system with a pocket field tool.

SUMMARY OF THE INVENTION

A foldable pocket field tool having a foldable pliers and a set of specialty field tool bits to enable the foldable pocket tool to be carried on a person and used on-the-go. While the foldable pocket tool does not include an actually specialty tool it does include a work head or tool bit that may be part of a set of field tools and more specifically a set of tool bits tool bits extendable or retractable into a handle and with each of the tool bits operable for efficiently performing a unique service tasks that may occur when installing or servicing a field system such as an irrigation system. Since the tool bits remain secured to the pocket tool the tool bits are available on demand. The specialty tool bits may include a one-piece two step tool bit for manually forming holes of different sizes and shapes, an elongated tool bit for clearing or cleaning a clogged passage, a cross driver for engaging and rotating a screw with a head having a cross slot and a hexagonal shaft for rotating engaging a female socket. The tool bits may be arranged to provide a two-part handle for use in manipulating an adjacent tool bit about a central axis as the tool bit is supported by the foldable pocket tool.

DESCRIPTION OF THE PREFERRED EMBODIMENT

Figure 1:
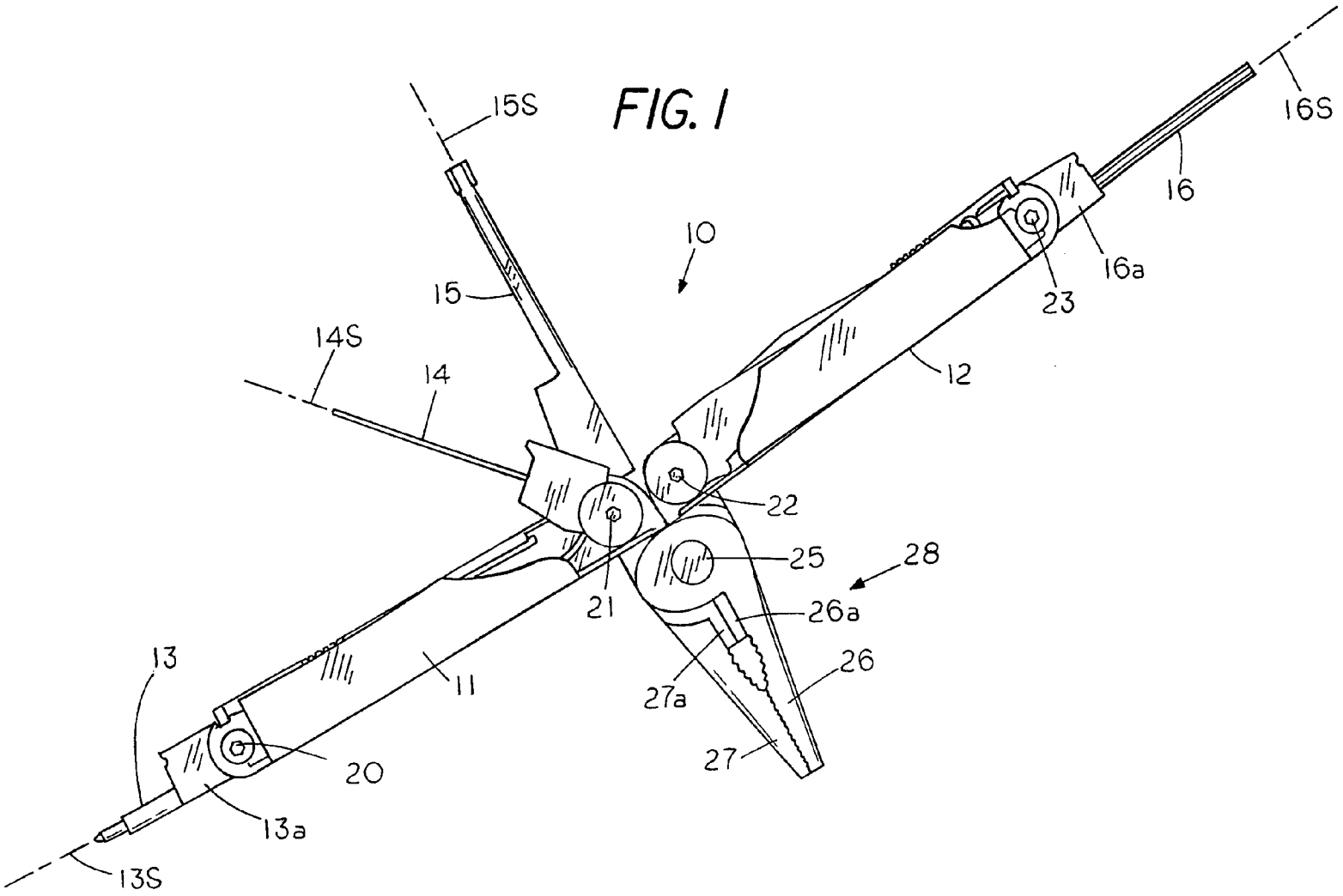
FIG. 1 is a front view of a pocket tool in an open condition.
Figure 2:
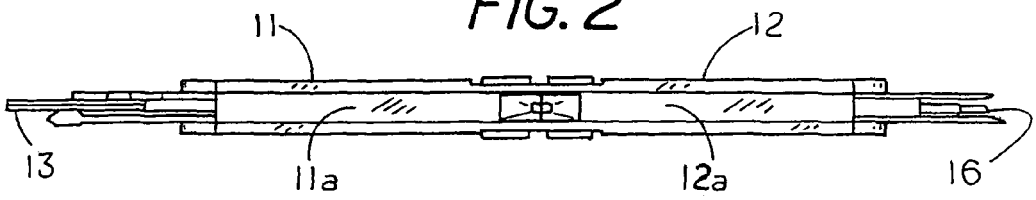
FIG. 2 is a top view of the pocket tool of FIG. 1.

FIG. 1 shows a foldable pocket field tool 10 in a splayed condition with four different specialty tool bits pivotally mounted to the pocket field tool to enable the specialty tool bits to be used individually and without detachment from the pocket field tool. Pocket field tool 10 includes a pliers 28 with a first jaw 26 and a second jaw 27 with the jaws of the pliers supported in a pivoting relationship to each other by a common pivot pin 25. When in pliers mode handle 11 and handle 12 provide for opening and closing jaw 26 and 27. In the pliers mode the specialty tool bits as described hereinafter would normally be folded into compartments or tool bit channel in handles 11 and 12. FIG. 2 is a top view of the pocket tool of FIG. 1 showing tool bit channel 11*a*, which is located in handle 11, and tool bit channel 12*a* which is located in handle 12.

The jaws of the pliers 28 include a Vee shaped wire cutting blade 26*a*, which is located on jaw 26, and a Vee shaped wire-cutting blade 27, which is located on jaw 27. The jaws and wire cutters make the pliers useful for general field technician tasks including holding or cutting small objects such as a wire or the like. In the example shown in FIG. 1 the jaw 26 is supported on handle 12 by pivot pin 22 and the jaw 27 is supported on handle 11 by pivot pin 21.

FIG. 1 shows a set of specialty tool bits 13,14,15 and 16, which are positioned on the pocket field tool 10 so that a user has an extension or handle on each side of the tool bit where a portion of a two-part handle may be another tool bit. That is, the arrangement of the tool bits 13, 14, 15 and 16 creates a two-part tool bit handle for each tool bit where the handle for the tool bits are formed by other tool bits, the jaws of the pliers 28, handle 11 or handle 12. Thus a feature of the invention includes the use of tool bits with handles extending laterally outward from a central axis extending through the tool bit. FIG. 1 shows a central axis 13*s* extending from a one-piece tool bit 13, a central axis 14*s* extending from tool bit 14, a central axis 15*s* extending from tool bit 15 and a central axis

16*s* extending from a rigid driver tool bit 16 having a notch 16*b* for rotating mounting base from a stored condition to a working position.

To use driver tool bit 16 one can use tool bit 15 and tool bit 14 as part of a two-part handle as well as the jaw 26 and jaw 27 of the pliers 28 as the other part of the two-part handle. Similarly, to use tool bit 13 one can use tool bit 15 and tool bit 14 as a part of a two-part handle as well as the jaws 26 and 27 of the pliers 28. Using the two-part handles one can apply a radially distributed torque about a central axis through the tool bit.

To use tool bit 15 one can rotate tool bit 14 into a closed condition and use the handle 11 and the handle 12 which are on opposite sides of the tool bit 15 as a two-part handle to rotate the tool bit 15 about axis 15*s*. Similarly, to use tool bit 14 one can rotate tool bit 15 into a closed condition and use the handle 11 and the handle 12 as the two-part handle which is located on opposite sides of the tool bit 14 to rotate the tool bit 14 about central axis 14*s*. Thus, a feature of the invention is the positioning of the tool bits so that the two-part handles are located on opposite side of the tool bit and extend laterally outward from a central axis through the tool bit thus enabling one to apply torque to the tool bit from each side of the tool thus increasing the effectiveness of the tool. In addition, the use of the two-part handles also allows one to effectively exert an axial balanced downward pressure on the tool bit to maintain the tool bit in contact with the article being worked on.

Figure 3:
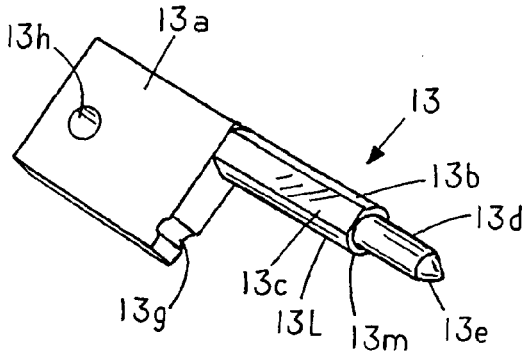
FIG. 3 is a perspective view of a two-step tool bit.
Figure 5:
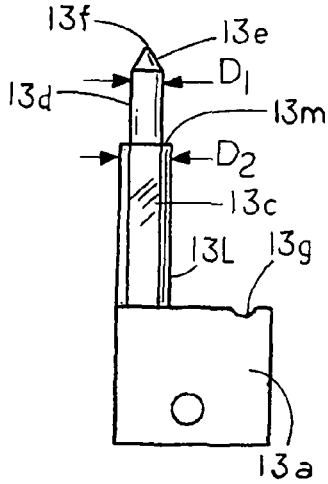
FIG. 5 is front view of the two-step tool bit of FIG. 3.
Figure 4:
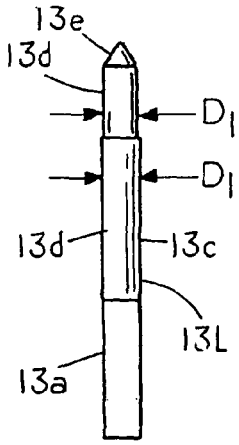
FIG. 4 is a side view of the two-step tool bit of FIG. 3.
Figure 15:
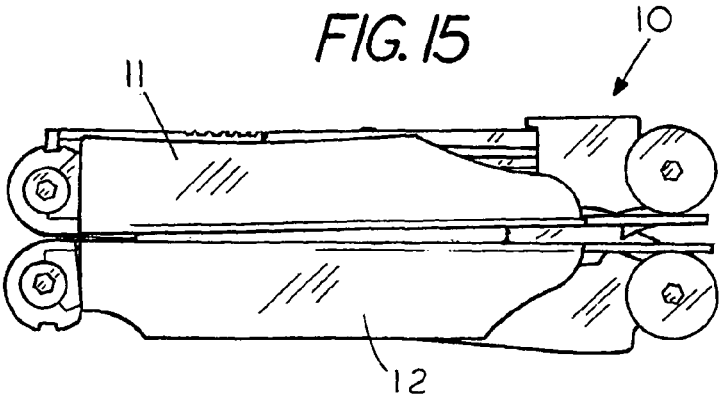
FIG. 15 shows the pocket tool of FIG. 1 in a folded condition.

Located at one end of pocket field tool 10 is a tool bit comprising a driver 16 having an elongated solid shaft with a hexagonal cross section and a mounting base 16*a* rotateable supported by a pivot pin 23. The driver 16 is foldable into a concealed condition within handle 12 when not in use. FIG. 15 shows the pocket field tool 10 in a closed condition with the elongated shaft of driver 16 folded into the handle 12. Located on the other end of pocket tool 10 is a two-step tool bit 13 having a mounting base 13*a* pivotally mounted on pivot pin 20. FIG. 3 shows an isolated perspective view of the two-step tool bit 13 for manually forming openings of different sizes and shapes through hand manipulation of the pocket field tool while FIG. 4 and FIG. 5 show the two-step tool bit 13 in front and side views while FIG. 5 shows an end view. Tool bit 13 includes a flat rectangular shaped base 13*a* having an opening 13*h* for pivotally mounting base 13*a* to a pivot pin 20 of foldable pocket field tool 10. Located on edge of base 13*a* and extending there across is a lateral notch 13*g* that allows a user to rotate the tool bit 13 from a closed condition to an open condition by inserting a finger nail into lateral notch 13*g* and rotating the tool bit 13 out of a stored condition within the handle 11 of the pocket tool. Tool bit 13, although having a fixed shape allows one to manually form holes of different shape and different sizes in a material, for example a sheet of plastic, a pipe or other material. FIG. 5 shows the tool bit 13 includes a first hole forming member having a circular shaft 13*d* of diameter $D_1$ with a conical tip 13*e* terminating at 13*f* to form a pointed piercing member that expands the material while forming a hole rather than punching an opening through the material. Tool bit 13 includes a second non-circular shaft 13L extending from a transverse base 13*m* of circular shaft 13*d* with shaft 12L having a first rectangular flat 13*b* extending along one side and a second rectangular flat 13*c* extending along an opposite side with the flat 13*a* and flat 13*b* located in a parallel condition to each other to form an oblong shape. FIG. 4 shows the width $D_1$ of a working face 13*d* and 13*c* are the same as the diameter D1 of the shaft 13*d* of the two-step tool bit are the same. While FIG. 4 shows the width from flat 13*a* to flat 13*b* is $D_1$ in a transverse direction FIG. 5 shows the tool bit 13 with shaft 13*c* having a dimension $D_2$ with dimension $D_2$ greater than dimension $D_1$ of shaft 13*d*.

Figure 6:
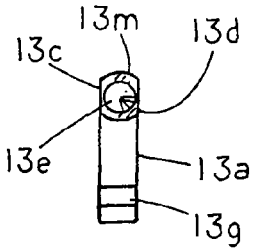
FIG. 6 is an end view of the two-step tool bit of FIG. 3.
Figure 6A:
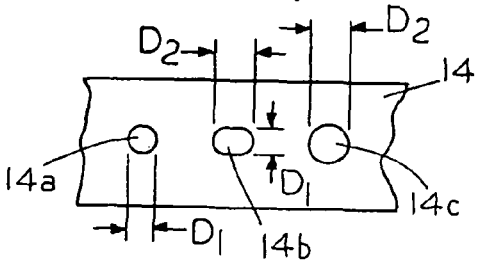
FIG. 6A is a top view of an article having holes formed by the two-step tool bit of FIG. 3.
Figure 7:
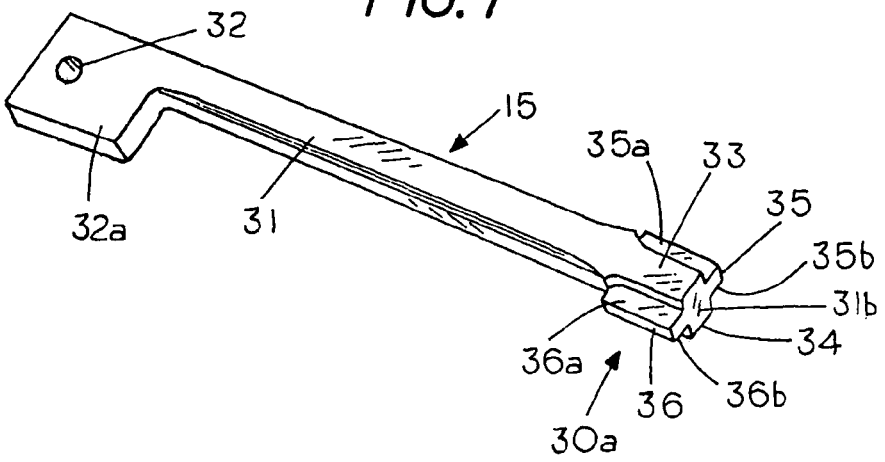
FIG. 7 is a perspective view of a cross driver tool bit.
Figure 8:
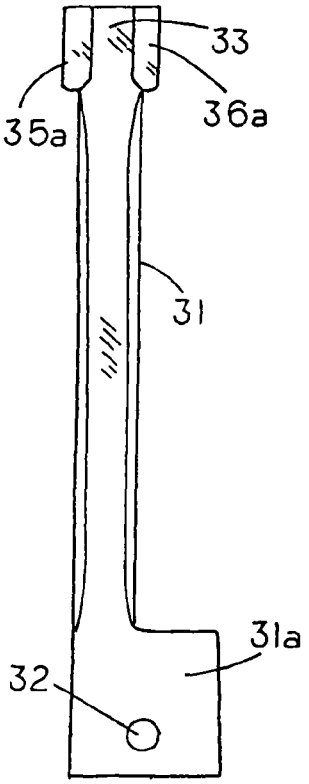
FIG. 8 is a front view of a cross driver tool bit.
Figure 9:
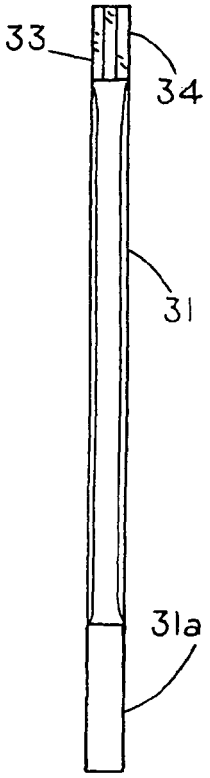
FIG. 9 is a side view of a cross driver tool bit.
Figure 10:
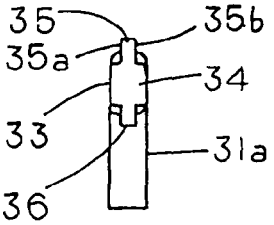
FIG. 10 is an end view of a cross driver tool bit.

In one phase of operation of tool bit 13 one penetrates an object with a first portion of a pointed tool bit having a cylindrical shaft 13*d* having a first diameter $D_1$ to form a cylindrical opening of a first size and by continuing to penetrate the object with a second portion of the tool bit having a non-circular shaft 13*c* having at least a portion having a greater cross sectional dimension than the diameter $D_1$ of first portion of the tool bit one can form an enlarged opening having an elongated non-circular shape 14*b* as shown in FIG. 6A.

In hand operation of the tool bit 13 of FIG. 3 the base 13*a*, which is supported on a pivot pin 20 of the folding pocket member 10, allows the user to grip handle 11 as well as the two-part handle formed by tool bit 14, tool bit 16 and pliers 28 to thereby form a two-part handle that extends transverse to an axis of the tool bit which allows one to apply both an axial and a rotational force to the tool bit 13 thereby enabling the service technician to form holes of different size and shape all without the aid of power tools and or multiple drill bits. Using tool bit 13 one can form a first hole in an object having a diameter $D_1$, for example a polymer plastic pipe, by grasping the handle 11 and applying axial force to tool bit 13 to force conical tip 13*e* and shaft 13L through the pipe until the pipe encounters base 13*m* which acts as an axial stop to limit further axial penetration of tool bit 13. By limiting the axial insertion to shaft 13*d* one can make a hole having a diameter $D_1$ equal to the diameter of shaft 13*d* . To make a larger hole of a different shape one continues to exert axial force on tool bit 13 to force the stepped section 13*c* through the material thus creating a non-circular hole or oblong hole with a dimension $D_1$ in one direction and $D_2$ in a transverse direction. Thus, tool bit 10 can be hand manipulated to make two different size holes by manually controlling the axial penetration of the tool bit 13. A further feature of tool bit 13 is that one can make a hole of a third size, without an additional bit, that is by rotating tool bit 13 and member 13*d* one can form a circular opening having a diameter $D_2$ in the material which is larger than the diameter $D_1$ of the first member. To illustrate the shape and sizes of holes hand formable with tool 13 reference should be made to FIG. 6A which shows a first circular hole 14*a* of diameter $D_1$, an oblong hole with a maximum dimension $D_2$ and a minimum dimension D1 and a third circular hole having a diameter $D_2$.

As shown in FIG. 1 pocket field tool 10 includes a one-piece cross driver tool bit 15 which is shown in isolated view in FIGS. 7,8,9 and 10. Tool bit 15 includes a planar mounting base 32*a* rotateable mounted to pivot pin 21 with base 32*a* having the same thickness as throughout. Extending from base 32*a* is an elongated shaft 31 having a head 30*a* thereon with a blunt end 31*b* and a base 31*a* for engaging a pivot pin of a pocket tool. Head 30*a* has a first lobe 33 and a second lobe 34 with a first rigid ear 35 having a first face 35*a* and a second face 35*b* extending laterally outward from one side of head 30*a* and a second rigid ear 36 having a first face 36*a* and a second face 36*b* extending laterally outward from the opposite side of head 30*a* to form a cross driver 30 rotationally engageable with an article having a cross slot, for example in an apparatus such as an irrigation valve. A feature of cross driver tool bit 30 is that head 30*a* may be formed by swaging edge portions of the end of shaft 31.

Figure 11:
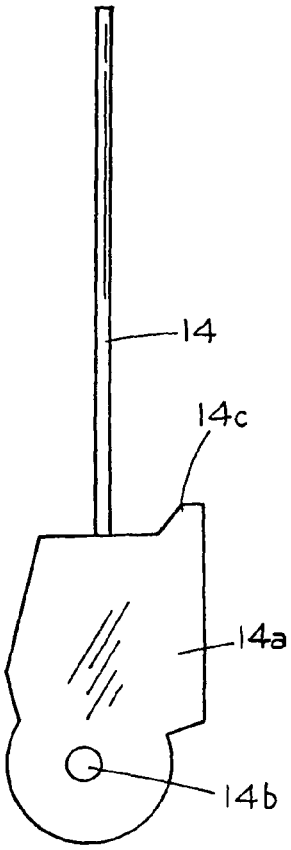
FIG. 11 is a front view of a tool bit.
Figure 12:
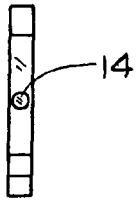
FIG. 12 is an end view of the tool bit of FIG. 11.
Figure 13:
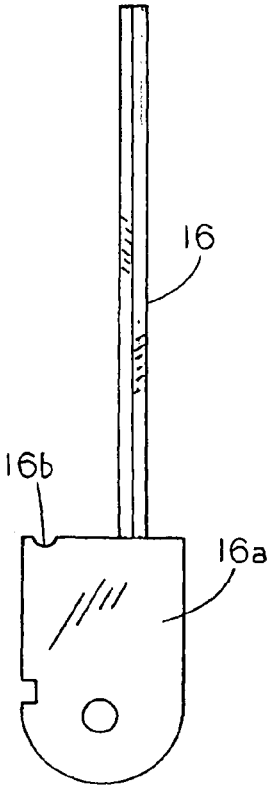
FIG. 13 is a front view of a hex driver tool bit.
Figure 14:
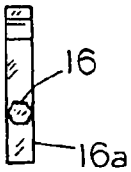
FIG. 14 is an end view of the hex driver tool bit of FIG. 13.

A reference to FIG. 11 and FIG. 12 reveals a multipurpose bit 14 comprising an elongated rigid cylindrical rod or pin having a mounting base 14*a* with a hole 14*b* therein for rotateable mounting base 14*a* to pocket field tool 10 though pivot pin 21 (FIG. 1). FIG. 1 shows multipurpose bit 14 extending outward from the tool. Multipurpose bit 14 may be used for a variety of functions including cleaning out existing holes or passages in pipelines or other functions such as checking depths of blind holes. A lip 14*c* permits for engaging mounting base 14*a* to rotate tool bit 14 from a stored condition.

Figure 16:
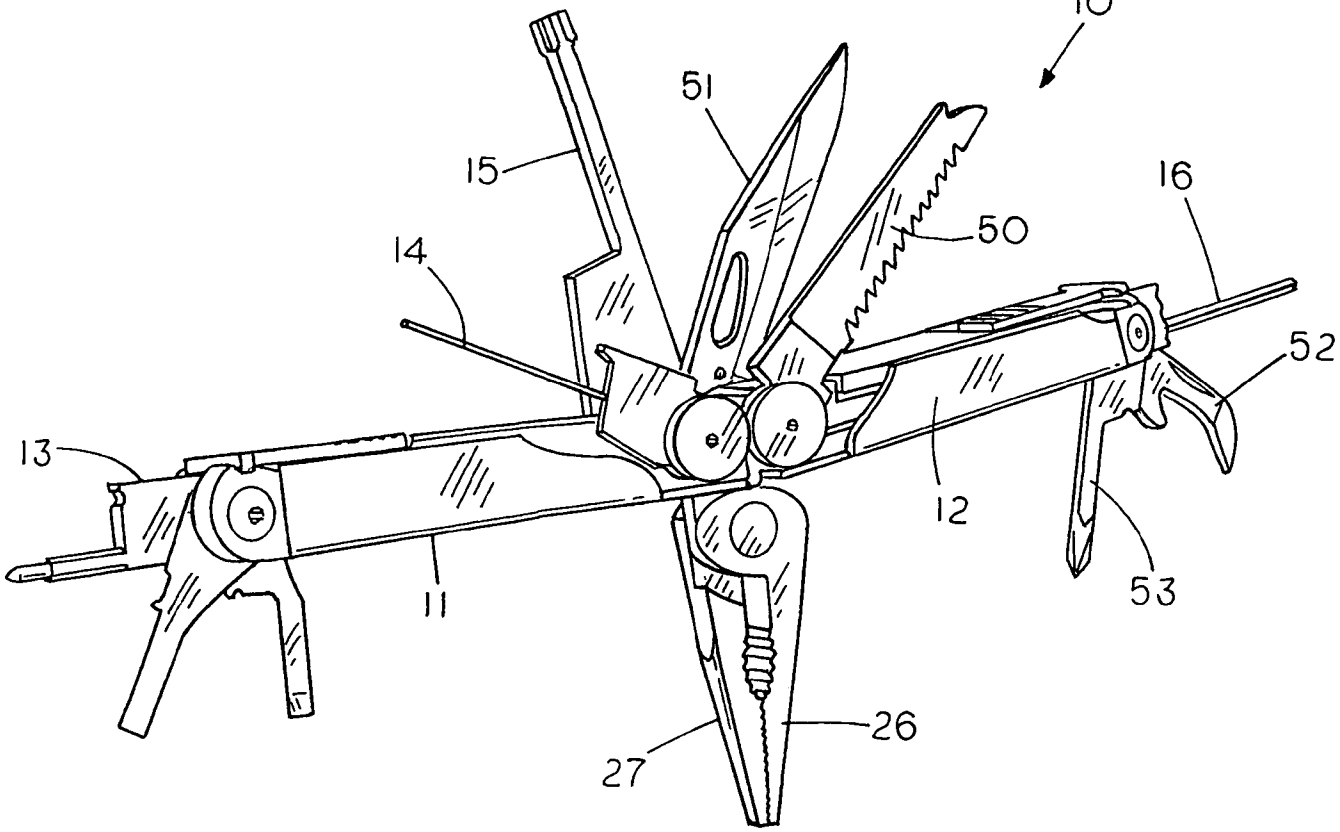
FIG. 16 shows the pocket tool of FIG. 1 with conventional utility tools secured to the pocket tool.

FIG. 16 illustrates how other utility tools such as a can opener 52, a Phillips screwdriver, a knife 51 and a saw 50 may be attached to the pocket field tool without departing from the spirit and scope of the present invention and FIG. 15 shows the pocket field tool 10 in a folded condition where the tools and tool bits are concealed within the handles 11 and 12 of the pocket field tool 10.

We claim:

1. A foldable pocket field tool having:

a first handle having a first pivot pin on one end and a second pivot pin on the opposite end with a tool bit channel extending therebetween;

a second handle having a first pivot pin on one end and a second pivot pin on the opposite end with a tool bit channel extending therebetween;

a two step manual tool bit having a base end pivotally mounted on one of said pivot pins, said tool bit having a conical tip thereon for sizing and shape forming an opening of a first shape and a stepped member for forming an opening of a second shape through expansion of material proximate the tool bit through controlling axial penetration of the tool bit therein, said tool bit rotateable in situ to form the opening of the second shape into a third opening of the same shape as the first opening with the third opening having a larger diameter than a diameter of the first opening, said manual tool bit foldable between an operative position and a closed condition within one of said handles when the two step tool bit is not in use;

a tool bit having a hexagonal cross section with a mounting base rotatably supported by one of said pivot pins with said elongated shaft foldable into a concealed condition within one of said handles when not in use;

a tool bit comprising a rigid cylindrical push rod having a mounting base pivotally mounted on one of said pivot pins with said cylindrical push rod rotateable into a concealed condition within one of said handles; and a driver bit having an elongated shaft with a driver head with a first rigid rectangular ear extending from one side of the head and a second rigid rectangular ear extending from an opposite side of the head.

2. The foldable pocket field tool of claim 1 including a first pliers jaw and a second pliers jaw rotationally secured to each other with said first handle and said second handle cooperatively opening and closing the first pliers jaw and the second pliers jaw.

3. The foldable pocket field tool of claim 1 wherein the stepped member has a flat member extending axially along one side and a flat member extending in a parallel direction on an opposite side of the two-step tool bit.

4. The foldable, pocket field tool of claim 3 wherein the flat member along one side of the two step tool bit and the flat member along the opposite side of the two-step tool bit have an oblong cross sectional shape.

5. The foldable pocket field tool of claim 1 wherein a, tool bit forms a portion of a handle for manipulating another tool bit.

6. The foldable pocket field tool of claim 1 wherein one of the tool bit forms a portion of a handle for manipulating another tool bit and the pliers forms a further portion of the handle for manipulating the another tool bit.

7. The foldable pocket field tool of claim 1 wherein the two step tool bit is pivotally mounted to the one handle and the driver bit is pivotal mounted to the second handle and the width of a working face of each of the faces of the two-step tool bit are the same.

8. The foldable, pocket field tool of claim 1 wherein the two step tool bit is operable through handles formed by a pliers jaw and another of the tool bits.

9. The foldable pocket field tool of claim 1 wherein at least one of the tool bits is mounted on a pivot pin for a jaw of a pliers.

10. A foldable irrigation pocket field tool having:

a first handle having a first pivot pin on one end and a second pivot pin on the opposite end with a tool bit channel extending therebetween;

a second handle having a first pivot pin on one end and a second pivot pin on the opposite end with a tool bit channel extending therebetween;

a set of pliers jaws supported by said first handle and said second handle; and a set of tool bits wherein each of the tool bits are pivotally mounted to either the first handle or the second handle and at least one of the tool bits is a two step tool bit having a conical tip thereon for sizing and shape forming a first opening by radially expanding material as the two step tool bit axially penetrates an object with the two step tool bit including a first flat extending along one side of the tool bit and a second flat extending along an opposite side with the first flat and the second flat forming an oblong shape at a base of the two step tool bit for forming a second opening of different size than the first opening as the two step tool bit continues to penetrate the object.

11. The foldable pocket field tool of claim 10 including a further tool bit pivotally mounted opposite the set of pliers jaw so that the set of pliers jaw and the further tool bit form a two-part handle for rotating the two-step tool bit.

12. The foldable pocket field tool of claim 11 including a tool bit having a head with a blunt end and a set of ears that extend laterally outward from the tool bit.

13. A method of forming an opening in an article with a pocket tool comprising the steps of:

penetrating an object with a first portion of a pointed tool bit having a cylindrical shaft having a first diameter $D_1$ to form a cylindrical opening of a first size; and continuing to penetrate the object with a second portion of the tool bit having a non-circular shaft having at least a portion having a greater cross sectional dimension than the diameter $D_1$ of first portion of the tool bit to form an enlarged opening having an elongated non-circular shape therein.

14. The method of claim 13 including the step of rotating the tool bit when the second portion of the tool bit is located in the object to change the shape of the enlarged opening to a yet larger opening with a circular shape.

15. The method of claim 14 including the step of using jaw of a pliers and a further tool bit has a two-part handle to rotate the tool bit about a central axis.

16. The method of claim 13 including engaging a member with another tool bit and using jaw of a pliers and a further tool bit has a two-part handle to rotate the another tool bit about a central axis.

17. The method of claim 13 including the step of pivoting each of the tool bits into a conceal condition.

18. The method of claim 13 in using the tool bit to adjust an apparatus in an irrigation systems.

19. The method of claim 13 including the step of extending one handle in a first direction and the second handle in a second direction and using the first handle and the second handle to rotate a tool bit about a central axis through the tool bit.

20. The method of claim 13 wherein each of the tool bits are formed from a rigid material with a base rotatably mountable in the pocket tool.

* * * * *